US006384795B1

(12) United States Patent
Bhattacharyya et al.

(10) Patent No.: US 6,384,795 B1
(45) Date of Patent: May 7, 2002

(54) MULTI-STEP CIRCULAR HORN SYSTEM

(75) Inventors: Arun K. Bhattacharyya, El Segundo; Guy Goyette, Marina del Rey, both of CA (US)

(73) Assignee: Hughes Electronics Corp., El Segundo, CA (US)

( * ) Notice: Subject to any disclaimer, the term of this patent is extended or adjusted under 35 U.S.C. 154(b) by 0 days.

(21) Appl. No.: 09/666,203

(22) Filed: Sep. 21, 2000

(51) Int. Cl.[7] ..... H01Q 13/00
(52) U.S. Cl. ..... 343/786; 343/772
(58) Field of Search ..... 343/725, 756, 343/772, 776, 781 R, 786

(56) References Cited

U.S. PATENT DOCUMENTS 4,122,446 A * 10/1978 Hansen ..... 343/786
5,894,289 A * 4/1999 Tamura ..... 343/786
6,163,304 A * 12/2000 Peebles et al. ..... 343/786

* cited by examiner

*Primary Examiner*—Don Wong
*Assistant Examiner*—Shih-Chao Chen
(74) *Attorney, Agent, or Firm*—Terje Gudmestad

(57) ABSTRACT

A multi-step circular horn system may have several steps and may use more than one flared section based upon design considerations. In order to achieve high aperture efficiency, the aperture field distribution is close to uniform. For good cross-polar performance, the field distribution is circularly symmetric. Location and shape of the steps is determined by the wavelength of the signal being transmitted and the space constraints imposed by the antenna design. The step discontinuities generate desired modes of operation in the right proportion.

13 Claims, 1 Drawing Sheet

MULTI-STEP CIRCULAR HORN SYSTEM

TECHNICAL FIELD

The present invention relates generally to satellite communication systems, and more particularly, to a multi-step circular horn system for satellite communication systems.

BACKGROUND ART

Satellites and other spacecraft are in widespread use for various purposes including scientific research and communications. These scientific and communications missions, however, cannot be accurately fulfilled without wireless communication between a ground station and the spacecraft. In many applications, the satellite relies upon a wireless communication to send and receive electronic data to perform attitude and position corrections, diagnostic status checks, communication calculations and other functions. Without accurate wireless communication, proper satellite function is hindered and at times adversely effected.

Many modern spacecraft use potter horn systems for directing radiated radio signals. For direct radiating horn arrays, it is desirable that the horn elements have a high aperture efficiency to minimize the number of elements for a desired array gain. A potter horn, designed for low cross-polar level, typically has approximately 70% aperture efficiency.

Additionally, prior art horns may be used for reflector antennas producing multiple beams, commonly known as Multiple Beam Antennas (MBA). A typical coverage for an MBA is multiple uniform beam-cells, arranged in hexagonal grids that cover a certain area on the Earth's surface. To simplify the beam forming network (BFN) structure, a single feed element is used to introduce a beam-cell. The cell spacing and the beam deviation factor of the reflector surface determines the maximum feed aperture size that can be used without mechanical interference of the feeds. Unfortunately, because of this, the required feed size is often too small. If a Potter or a conventional corrugated horn feed is used, the illumination taper on the reflector edge would be too low, creating a secondary beam with high sidelobes and increasing the interference level between neighbor cells reusing the frequency.

The disadvantages associated with these conventional radiating horn techniques have made it apparent that a new technique for a radiating horn is needed. The new technique should improve aperture efficiency while improving overall system performance. Additionally, the new technique should help reduce the number of elements required to support a Direct Radiating Array. The present invention is directed to these ends.

SUMMARY OF THE INVENTION

It is, therefore, an object of the invention to provide an improved and reliable multi-step circular horn system. Another object of the invention is to improve aperture efficiency while improving overall system performance.

In accordance with the objects of this invention, a multi-step circular horn system is provided. In one embodiment of the invention, a multi-step circular horn system may have several steps and may use more than one flared section based upon design considerations. In order to achieve high aperture efficiency, the aperture field distribution is close to uniform. For good cross-polar performance, the field distribution is circularly symmetric. Location and shape of the steps is determined by the wavelength of the signal being transmitted and the space constraints imposed by the antenna design. The step discontinuities generate desired modes of operation in the right proportion.

The present invention thus achieves an improved multi-step circular horn system. The present invention is advantageous in that it reduces the number of elements required to support a Direct Radiating Array and allow to improve the interference between beams in case of a Multi Beam Antenna.

Additional advantages and features of the present invention will become apparent from the description that follows, and may be realized by means of the instrumentalities and combinations particularly pointed out in the appended claims, taken in conjunction with the accompanying drawings.

BRIEF DESCRIPTION OF THE DRAWINGS

In order that the invention may be well understood, there will now be described some embodiments thereof, given by way of example, reference being made to the accompanying drawings, in which.

BEST MODES FOR CARRYING OUT THE INVENTION

Figure 1:
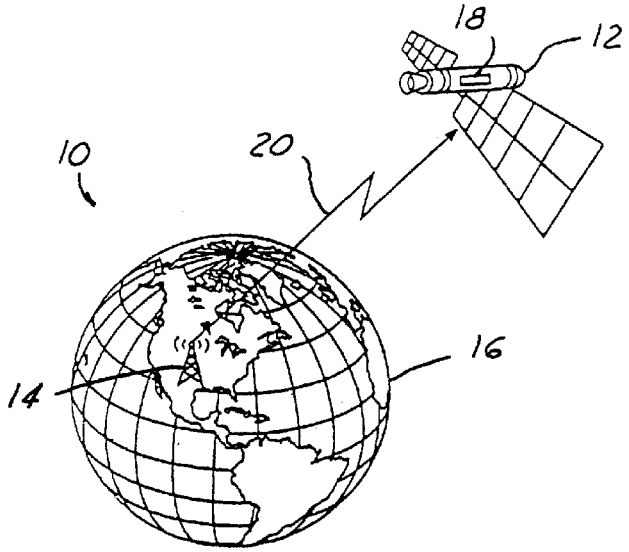
FIG. 1 is a perspective view of a satellite system having a multi-step circular horn system in accordance with one embodiment of the present invention.

In the following Figures, the same reference numerals will be used to identify identical components in the various views. The present invention is illustrated with respect to a multi-step circular horn system, particularly suited for the aerospace field. However, the present invention is applicable to various other uses that may require multi-step circular horn systems.

Referring to FIG. 1, a perspective view of a satellite system in accordance with one embodiment of the present invention is illustrated. The satellite system 10 is comprised of one or more satellites 12 in communication with a ground station 14 located on the Earth 16. Satellite 12 relies upon wireless communication to send and receive electronic data to perform attitude and position corrections, diagnostic status checks, communication calculations and other functions. Without accurate wireless communication, proper satellite function is hindered and at times adversely effected. Each satellite 12 contains one or more multi-step circular horn systems 18 to radiate radio signals.

For direct radiating horn arrays, it is desirable that the horn elements have a high aperture efficiency to minimize the number of elements for a desired array gain. A potter horn, designed for low cross-polar level, typically has approximately 70% aperture efficiency. The present invention with comparable aperture dimensions to prior art horns yields more than 85% aperture efficiency. The cross-polar performance is better than −33 dB. Therefore, if the invention is used in an array, the number of elements required would be 20% less than an array using Potter horns for obtaining similar array gain.

Figure 2:
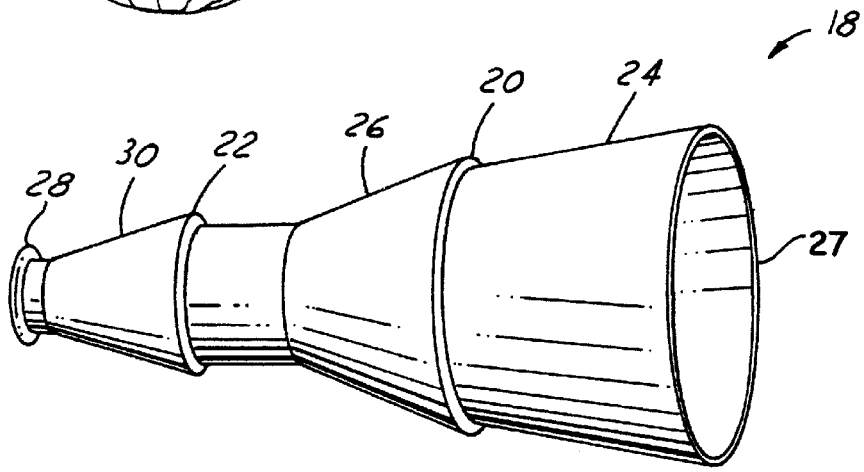
FIG. 2 is an isometric view of a multi-step circular horn system in accordance with one embodiment of the present invention.
Figure 3:
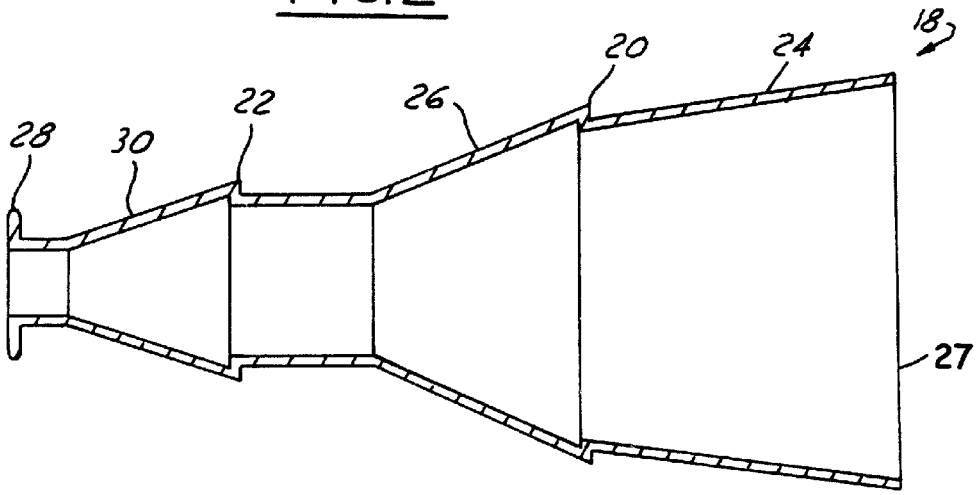
FIG. 3 is a cross sectional view of a multi-step circular horn system in accordance with one embodiment of the present invention is illustrated.

Referring to FIGS. 2 and 3, isometric and cross sectional views of a multi-step circular horn system 18 in accordance with one embodiment of the present invention are illustrated. Multi-step circular horn system 18 has a first step 20, second step 22, a first flare 24, a second flare 26, and a flange 28. One skilled in the art, however, would realize that multi-step circular horn system 18 may have several steps and may use more than one flared sections based upon design considerations. In order to achieve high aperture efficiency, the aperture field distribution should be close to uniform. For good cross-polar performance, the field distribution should be circularly symmetric.

In a Potter horn, the aperture field distribution is made symmetric by adding $TM_{11}$, mode in the right proportion. However, in a Potter horn, field distribution is highly tapered from the center to the horn wall 26, therefore, even though the cross-polar performance is good, the aperture efficiency is poor, typically 70%. In the present invention, the aperture field distribution is made fairly symmetric and uniform so that high aperture efficiency is achieved while maintaining good cross-polar performance.

In order to have uniform aperture field on a circular aperture, the $TM_Z$ modes must not be present on the aperture plane. Only the $TE_Z$ modes should be present. Ideally, the normalized amplitudes for the $TE_{11}$, $TE_{12}$, $TE_{13}$, . . . modes should be 1.0, 0.146, 0.071, . . . and the corresponding phase angles should be 0, 180, 0, - - - degrees, respectively. For a given aperture size, the number of propagating $TE_Z$ modes are finite. The step discontinuities essentially generate these desired modes in the right proportion. The aperture dimension and the frequency of operation determine the locations and the sizes of the steps. For a horn of aperture diameter of about four wavelengths, the aperture of this horn can support only the first three $TE_Z$ modes ($TE_{11}$, $TE_{12}$, and $TE_{13}$). The first step must be created at a place where the $TE_2$ mode can propagate. The location of the first step should be at a location where the diameter of the section is about 1.7 O, where O is the free space wavelength. Similarly, the second step should generate the $TE_{13}$ mode, therefore the diameter of the horn at that location should be about 2.7 O. The flared sections are used to obtain appropriate relative phase of the modes on the aperture. A third flare 30 before the second step 22 is used for input matching.

In practice, a high-efficiency multiple steps horn was designed according to the present invention to cover 28.35 to 30 GHz band. The aperture diameter was 1.52 inches. The designed length of the horn was about 2.6 inches. The return loss is better than −29 dB and the cross-polar level with respect to co-polar peak is better than −33 dB. It is possible to design a horn for aperture efficiency over 90% for about 10% bandwidth, but the crosspolar level at 17 degrees will degrade. For small scan angles (less than 10 degree scan) however, the cross-polar level is better than −30 dB even if the horn is designed for 90% (or more) aperture efficiency.

The present invention improves radiating horn aperture efficiency while improving overall system performance by including multiple steps at appropriate location to generate or reduce the higher order modes. Additionally, the present invention reduces the number of elements required to support a Direct Radiating Array.

From the foregoing, it can be seen that there has been brought to the art a new and improved multi-step circular horn system. It is to be understood that the preceding description of the preferred embodiment is merely illustrative of some of the many specific embodiments that represent applications of the principles of the present invention. Clearly, numerous and other arrangements would be evident to those skilled in the art without departing from the scope of the invention as defined by the following claims:

What is claimed is:

1. A multi-step horn system comprising:

a horn having an aperture opening and a radiating opening, said horn receiving a relatively uniform, circularly symmetric field distribution at said aperture opening, wherein said field has a given wavelength;

a first flare located on said horn between said aperture opening and said radiating opening;

a first step coupled to said first flare and located between said first flare and said aperture opening, said first step shape and location on said horn based upon said wavelength to generate a desired first mode; and a third flare coupled to a first flange and located between said first flange and said aperture opening.

2. The multi-step horn system as recited in claim 1, further comprising a second flare coupled to said first flange and located between said first flange and said aperture opening.

3. The multi-step horn system as recited in claim 2, further comprising a second step located between said second flare and said aperture opening, said second step shape and location on said horn based upon said wavelength to generate a desired second mode.

4. The multi-step horn system as recited in claim 3, wherein said third flare is coupled to said second step and located between said second step and said aperture opening, wherein said third flare is used for input matching.

5. The multi-step horn system as recited in claim 4, wherein said aperture opening comprises said first flange coupled to said third flare.

6. A satellite communications system, comprising;

a ground station;

a satellite in orbit and in communication with said ground station, said satellite having a multi-step circular horn system comprising:

a horn having an aperture opening and a radiating opening, said horn receiving a relatively uniform, circularly symmetric field distribution at said aperture opening, wherein said field has a given wavelength;

a first flare located on said horn between said aperture opening and said radiating opening;

a first step coupled to said first flare and located between said first flare and said aperture opening, said first step shape and location on said horn based upon said wavelength to generate a desired first mode; and a third flare coupled to a first flange and located between said first flange and said aperture opening.

7. The multi-step horn system as recited in claim 6, further comprising a second flare coupled to said first flange and located between said first flange and said aperture opening.

8. The multi-step horn system as recited in claim 7, further comprising a second step located between said second flare and said aperture opening, said second step shape and location on said horn based upon said wavelength to generate a desired second mode.

9. The multi-step horn system as recited in claim 8, further comprising a third flare coupled to said second flange and located between said second flange and said aperture opening, wherein said third flare is used for input matching.

10. The multi-step horn system as recited in claim 9, wherein said aperture opening comprises said first flange coupled to said third flare.

11. The multi-step horn system as recited in claim 6, wherein said horn is circular in shape.

12. The multi-step circular horn system as recited in claim 6, wherein said horn is rectangular in shape.

13. The multi-step circular horn system as recited in claim 6, wherein said horn is square in shape.

* * * * *